US008830027B2

(12) United States Patent
Sha et al.

(10) Patent No.: US 8,830,027 B2
(45) Date of Patent: Sep. 9, 2014

(54) SURFACE MOUNTABLE THERMISTOR

(75) Inventors: Yi An Sha, Xindian (TW); Chun Teng Tseng, Sanwan Township, Miaoli County (TW); David Shau Chew Wang, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 212 days.

(21) Appl. No.: 13/604,154

(22) Filed: Sep. 5, 2012

(65) Prior Publication Data

US 2013/0187748 A1 Jul. 25, 2013

(30) Foreign Application Priority Data

Jan. 20, 2012 (TW) ..... 101102423

(51) Int. Cl.
*H01C 7/00* (2006.01)

(52) U.S. Cl.
USPC ..... 338/22 R

(58) Field of Classification Search
USPC ..... 338/13, 22 R
See application file for complete search history.

(56) References Cited

U.S. PATENT DOCUMENTS

| | | | | |
|---|---|---|---|---|
| 8,461,956 | B2 * | 6/2013 | Tseng et al. | 337/5 |
| 8,502,638 | B1 * | 8/2013 | Sha et al. | 338/22 R |
| 8,525,636 | B1 * | 9/2013 | Sha et al. | 338/22 R |
| 2004/0195691 | A1 * | 10/2004 | Moriyasu et al. | 257/758 |
| 2007/0075823 | A1 * | 4/2007 | Sugiyama | 338/22 R |
| 2012/0075762 | A1 * | 3/2012 | Wang et al. | 361/93.8 |
| 2013/0187748 | A1 * | 7/2013 | Sha et al. | 338/22 R |

* cited by examiner

*Primary Examiner* — James Harvey
(74) *Attorney, Agent, or Firm* — Egbert Law Offices, PLLC

(57) ABSTRACT

A surface mountable thermistor comprises a resistive device, first and second electrodes, and at least one heat conductive dielectric layer. The resistive device contains first and second electrically conductive members and a polymeric material layer laminated therebetween. The polymeric material layer exhibits PTC or NTC behavior. The polymeric material layer and the first and second electrically conductive members commonly extend in a first direction. The first electrode is electrically coupled to the first electrically conductive member. The second electrode is electrically coupled to the second electrically conductive member and is insulated from the first electrode. The heat conductivity of the first electrode or the second electrode is at least 50 W/mK. The heat conductive dielectric layer comprises polymeric insulation matrix and heat conductive filler, and is disposed between the first electrode and the second electrode. The heat conductivity of heat conductive dielectric layer is between 1.2 W/mK-13 W/mK.

9 Claims, 3 Drawing Sheets

SURFACE MOUNTABLE THERMISTOR

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present application relates to a surface mountable thermistor, i.e., SMD type thermistor, comprising electrically conductive polymer, such as a positive temperature coefficient (PTC) device or a negative temperature coefficient (NTC) device, to provide over-current protection. In addition, the surface mountable thermistor is capable of detecting abnormal ambient temperatures.

2. Description of Related Art Including Information Disclosed Under 37 CFR 1.97 And 37 CFR 1.98

Because the resistance of conductive composite materials having a PTC characteristic is very sensitive to temperature variation, it can be used as the material for current sensing devices, and has been widely applied to over-current protection devices or circuit devices. The resistance of the PTC conductive composite material remains extremely low at normal temperatures, so that the circuit or cell can operate normally. However, when an over-current or an over-temperature event occurs in the circuit or cell, the resistance instantaneously increases to a high resistance state (e.g. at least $10^{2\Omega}$), so as to suppress over-current and protect the cell or the circuit device.

In high density circuit design and manufacturing, it is demanded that the protection devices have to be light, thin and small, and have to be surface mountable for being secured to circuit boards. Therefore, the thermistors having organic polymer have been designed to be various surface mountable electronic devices. However, when the device is applied to high temperature environment such as LED applications, the hold current thereof cannot increase due to the limitation of device dimensions and inferior heat transfer. Moreover, if the device is characterized in high thermal insulation, then the problem that the device is not sensitive to ambient temperature will occur.

BRIEF SUMMARY OF THE INVENTION

In order to overcome the above shortcomings, the thermistor of the present application uses insulation material with good heat conductivity for rapid heat transfer, thereby increasing the hold current thereof and the sensitivity to ambient temperatures.

In accordance with an embodiment of the present application, a surface mountable thermistor comprises a resistive device, a first electrode, a second electrode and at least one heat conductive dielectric layer. The resistive device contains a first electrically conductive member, a second electrically conductive member and a polymeric material layer laminated therebetween. The polymeric material layer exhibits PTC or NTC behavior. The polymeric material layer and the first and second electrically conductive members commonly extend in a first direction to form a laminated structure. The first electrode is electrically coupled to the first electrically conductive member, and the second electrode is electrically coupled to the second electrically conductive member and is insulated from the first electrode. The heat conductivity of the first electrode or the second electrode is at least 50 W/mK. The heat conductive dielectric layer contains polymeric insulation matrix and heat conductive filler, and is disposed between the first electrode and the second electrode. The heat conductivity of heat conductive dielectric layer is between 1.2 W/mK-13 W/mK.

In an embodiment, the surface mountable thermistor further comprises a first electrically conductive connecting member and a second electrically conductive connecting member. The first electrically conductive connecting member extends along a second direction perpendicular to the first direction to electrically connect the first electrode and the first electrically conductive member, and the first electrically conductive connecting member is insulated from the second electrically conductive member. The second electrically conductive connecting member extends along the second direction to electrically connect the second electrode and the second electrically conductive member, and the second electrically conductive connecting member is insulated from the first electrically conductive member. In an embodiment, the thermistor comprises two heat conductive dielectric layers, in which a first heat conductive dielectric layer and a second heat conductive dielectric layer are disposed on the first electrically conductive member and the second electrically conductive member, respectively.

In an embodiment, the polymeric insulation matrix comprises inter-penetrating network (IPN) of thermosetting epoxy resin and thermoplastic and has a single glass transition temperature. In another embodiment, the polymeric insulation matrix comprises thermosetting epoxy resin with fiber dispersed therein.

The present application provides a SMD device with improved material performance thereof to increase heat transfer efficiency, thereby increasing hold current of the device. Moreover, the device of the present application becomes sensitive to ambient temperatures, and therefore can be applied to secondary battery protection or other various electronics.

BRIEF DESCRIPTION OF THE SEVERAL VIEWS OF THE DRAWINGS

The present application will be described according to the appended drawings in which.

DETAILED DESCRIPTION OF THE INVENTION

Figure 1:
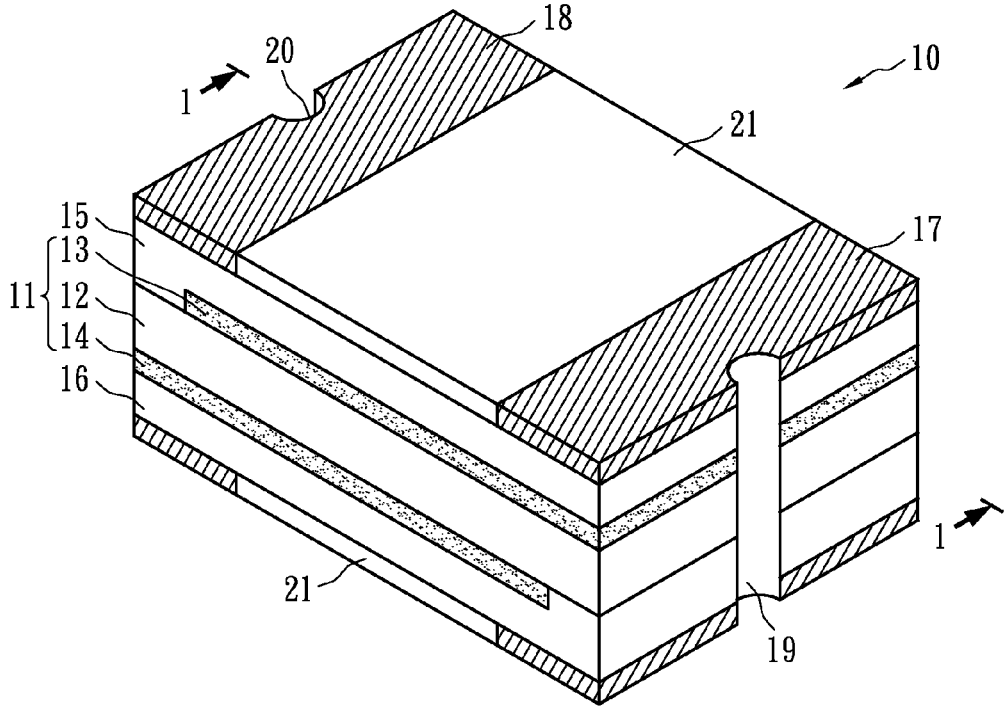
FIG. 1 shows a surface mountable thermistor in accordance with a first embodiment of the present application.
Figure 2:
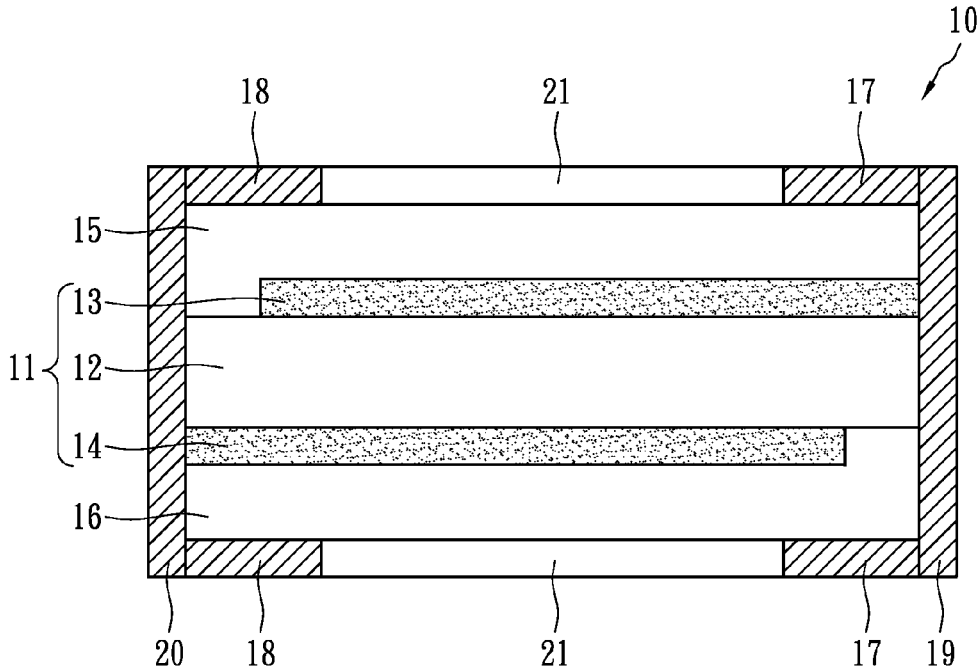
FIG. 2 shows a cross-sectional view of line 1-1 shown in FIG. 1.

FIG. 1 shows a surface mountable thermistor 10 in accordance with a first embodiment of the present application. FIG. 2 is the cross-sectional view along the line 1-1 shown in FIG. 1. The surface mountable thermistor 10 comprises a resistive device 11, a first electrode 17, a second electrode 18, heat conductive dielectric layers 15 and 16, a first electrically conductive connecting member 19 and a second electrically conductive connecting member 20. The resistive device 11 comprises a first electrically conductive member 13, a second electrically conductive member 14 and a polymeric material layer 12. The polymeric material layer 12 is laminated between the first electrically conductive member 13 and the second electrically conductive member 14. More specifically, the polymeric material layer 12, the first electrically conductive member 13 and the second electrically conductive member 14 commonly extend in a first direction (e.g., horizontal direction in FIG. 1) to form a laminated structure. The polymeric material layer 12 contains electrically conductive filler and exhibits PTC or NTC behavior, and the material thereof may comprise polyethylene, polypropylene, polyvinyl fluoride, the mixture or the copolymer thereof. The electrically conductive filler may contain metal particles, carbon-containing particles, metal oxide, metal carbide or the mixture thereof.

On the top and bottom surfaces of the polymeric material layer 12, the first and second electrically conductive members 13 and 14 extend to opposite sides of the resistive device 12, respectively. Two asymmetric indentations (one indentation is generated by stripping a metal film) are formed on the left side of the first electrically conductive member 13 and on the right side of the second electrically conductive member 14 by an ordinary method such as laser trimming, chemical etching or mechanical method from a planar metal foil. Materials of the electrically conductive members 13 and 14 may be nickel, copper, zinc, silver, gold, the alloy thereof, or laminated material formed by the materials mentioned above. In an embodiment, the indentation can be of rectangular, semi-circular, triangular, or irregular shape. After the indentations are formed, heat conductive dielectric layers 15 and 16 together with an upper metal foil and a lower metal foil are hot-pressed on the resistive device 11. Then, the metal foils may be etched to form isolations, thereby forming a first electrode 17 and a second electrode 18. As a result, the heat conductive dielectric layer 15 is formed an the first electrically conductive member 13, whereas the heat conductive dielectric layer 16 is formed on the second electrically conductive member 14. The first electrode 17 comprises a pair of electrode foils disposed on the surfaces of the heat conductive dielectric layer 15 and the heat conductive dielectric layer 16. The second electrode 18 has substantially the same structure, but in opposite side, as that of the first electrode 17.

The heat conductive dielectric layers 15 and 16 may use heat dissipation glues TCP-2, TCP-4 and TCP-8 manufactured by Polytronics Technology Corporation, IKA04, IKA06, IKA08, IKA10 or IKA12 manufactured by Laird, NRA-8, NRA-E-3, NRA-E-6, NRA-E-12 manufactured by NRK, TCP-1000, MP-06503, LTI-06005, HT-04503, TH-07006 manufactured by Bergquist, HTCA-60, HTCA-120 manufactured by E-Wintek or ERNE-800H manufactured by New Era Electronics. The heat conductivity of the heat conductive dielectric layer 15 or 16 is between about 1.2 W/mK and about 13 W/mK, and between about 2 W/mK and about 12 W/mK, or between about 3 W/mK and about 10 W/mK in particular. Moreover, the heat conductivity of the heat conductive dielectric layer 15 or 16 may be 4 W/mK, 5 W/mK, 6 W/mK, 7 W/mK, 8 W/mK or 9 W/mK.

The heat conductive dielectric layer 15 or 16 may comprise polymeric insulation matrix and heat conductive filler. The polymeric insulation matrix may comprise inter-penetrating network (IPN) of thermosetting epoxy resin and thermoplastic, or comprise thermosetting epoxy resin with fiber dispersed therein. The heat conductive filler may comprise zirconium nitride, boron nitride, aluminum nitride, silicon nitride, aluminum oxide, magnesium oxide, zinc oxide, titanium dioxide or the mixture thereof.

In an embodiment, the thermosetting epoxy resin may comprise end epoxy function group epoxy resin, side chain epoxy function group epoxy resin, multi-functional epoxy resin or the mixture thereof. The thermoplastic may use substantially amorphous thermoplastic resin. Many examples for the materials mentioned above are disclosed in U.S. Pat. No. 8,003,216 and U.S. Pub. Nos. 2008/0292857 and 2011/0214852, which are incorporated herein by reference.

Fiber and heat conductive filler are evenly dispersed into the polymeric insulation matrix. The fiber may comprise inorganic ceramic fiber, organic polymer fiber or the mixture thereof, such as glass fiber, aluminum oxide fiber, carbon fiber, polypropylene fiber, polyester fiber or the mixture thereof.

The first electrode 17 and the second electrode 18 may use metal foils containing nickel, copper, aluminum, lead, tin, silver, gold or the alloy thereof. Alternatively, the electrodes 17 and 18 may be copper foils plated with nickel, copper foils plated with tin or stainless foils plated with tin, of which the heat conductivities are greater than 50 W/mK. Those having heat conductivity greater than 200 W/mK or 300 W/mK are preferable, by which higher efficiency of heat transfer can be attained.

The first electrode 17 comprises a pair of electrode foils disposed on the surfaces of the heat conductive dielectric layers 15 and 16 and electrically connected through the first electrically conductive connecting member 19. The second electrode 18 comprises a pair of electrode foils disposed on the surfaces of the heat conductive dielectric layers 15 and 16 and electrically connected through the second electrically conductive connecting member 20. More specifically, the first electrically conductive connecting member 19 extends along a second direction perpendicular to the first direction to electrically connect the first electrode 17 and the first electrically conductive member 13, and the first electrically conductive connecting member 19 is insulated from the second electrically conductive member 14. The second electrically conductive connecting member 20 extends along the second direction to electrically connect the second electrode 18 and the second electrically conductive member 14, and the second electrically conductive connecting member 20 is insulated from the first electrically conductive member 13. The heat conductive dielectric layers 15 and 16 are disposed between the first electrode 17 and the second electrode 18 for insulation.

Semi-circular conductive holes are exemplified for electrically conductive connecting members 19 and 20, of which the surface can be plated with a conductive metal such as copper, nickel, tin or gold. In addition, the conductive holes can be of round, quarter-circular, parabolic, square, rhombus, rectangular, triangle or polygon shape. Alternatively, the two foils of the electrode 17 or 18 can be electrically connected by fullface electroplating with conductive films. In an embodiment, a gap may be formed between the electrode 17 and the electrode 18 for insulation, and the gap may be further filled with solder mask 21. In this embodiment, the solder mask 21 is of rectangular shape, others like semi-circular, parabolic, triangular or irregular shapes can be used instead.

The above design and manufacturing method can also be applied to an over-current protection device with two or more resistive devices 11, which are electrically connected in parallel, so as to form a surface mountable thermistor having multi-PTC layers.

Below illustrates other embodiments of surface-mountable thermistors with different structures, of which the material and its performance could refer to those described in the first embodiment.

Figure 3:
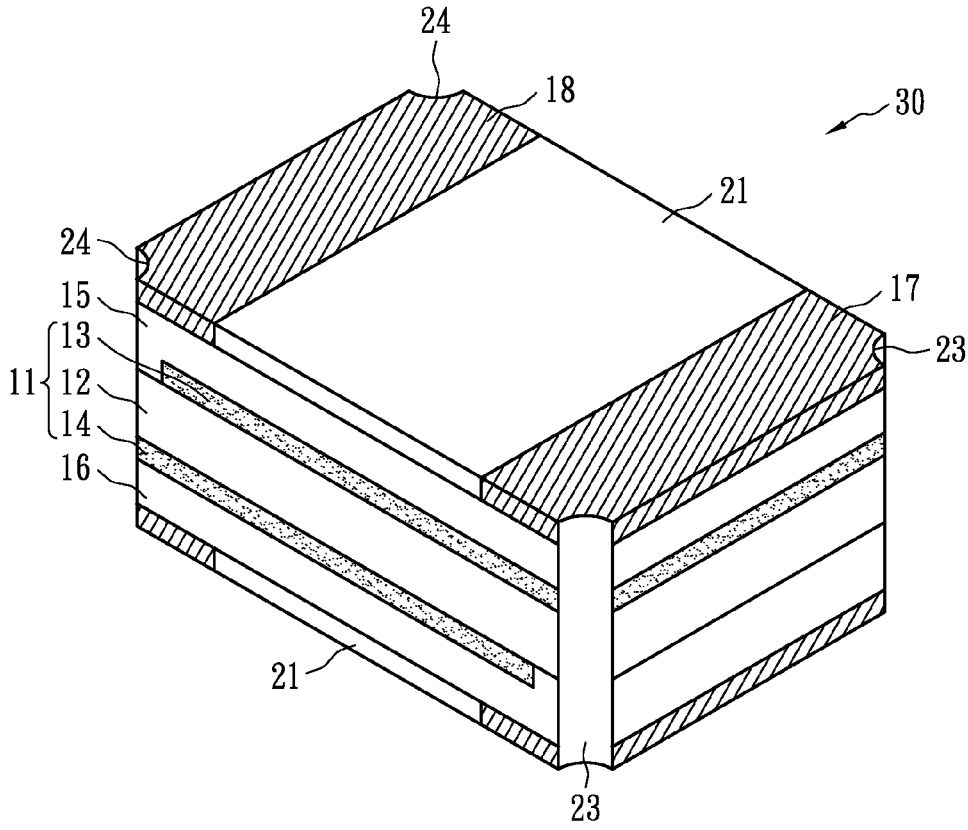
FIG. 3 shows a surface mountable thermistor in accordance with a second embodiment of the present application.

FIG. 3 shows a surface mountable thermistor 30 in accordance with a second embodiment of the present application. Unlike the thermistor 10 shown in FIG. 1, the first electrode 17 and the first electrically conductive member 13 are connected through electrically conductive connecting members 23 placed at two corners of the thermistor 30, whereas the second electrode 18 and the second electrically conductive member 14 are electrically connected through electrically conductive connecting members 24 at the other two corners of the thermistor 30.

Figure 4:
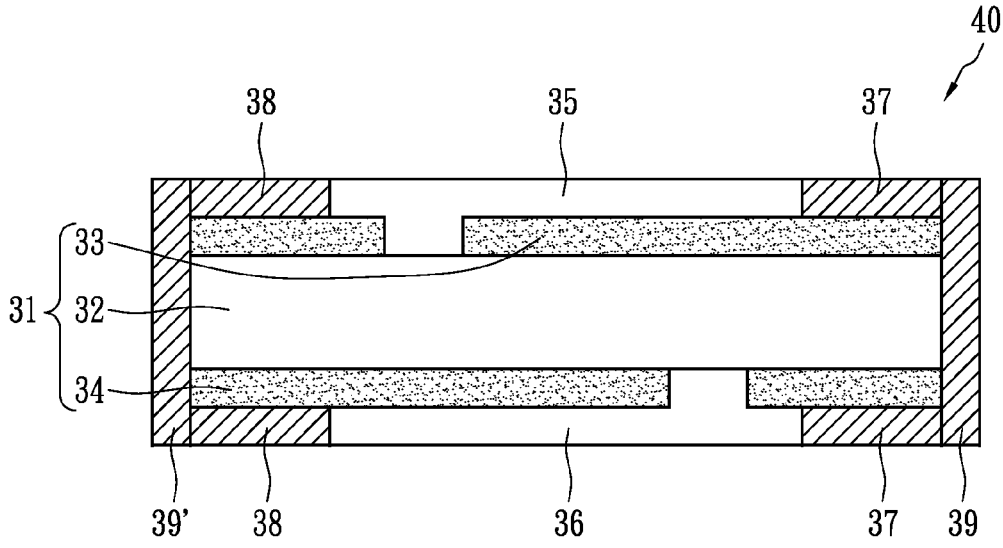
FIG. 4 shows a surface mountable thermistor in accordance with a third embodiment of the present application.

FIG. 4 shows a surface mountable thermistor 40 in accordance with a third embodiment of the present application. The thermistor 40 comprises a resistive device 31, a first electrode 37, a second electrode 38, heat conductive dielectric layers 35 and 36, a first electrically conductive connecting member 39 and a second electrically conductive connecting member 39'. The resistive device 31 comprises a first electrically conductive member 33, a second electrically conductive member 34 and a polymeric material layer 32. The polymeric material layer 32 is laminated between the first electrically conductive member 33 and the second electrically conductive member 34. More specifically, a gap is formed in a conductive layer on the upper surface of the polymeric material layer 32, and the portion of the conductive layer at the right side of the gap is the first electrically conductive member 33. Another gap is formed in a conductive layer on the lower surface of the polymeric material layer 32, and the portion of the conductive layer at the left side of the gap is the second electrically conductive member 34. The two foils of the first electrode 37 are electrically connected through the first electrically conductive connecting member 39, and are electrically connected to the first conductive member 33. The two foils of the second electrode 38 are electrically connected through the second electrically conductive connecting member 39', and are electrically connected to the second conductive member 34. The first electrode 37 and the second electrode 38 are in contact with the surfaces of the first electrically conductive member 33 and the second electrically conductive member 34. The heat conductive dielectric layers 35 and 36 are disposed between the first electrode 37 and the second electrode 38 for insulation therebetween.

Figure 5:
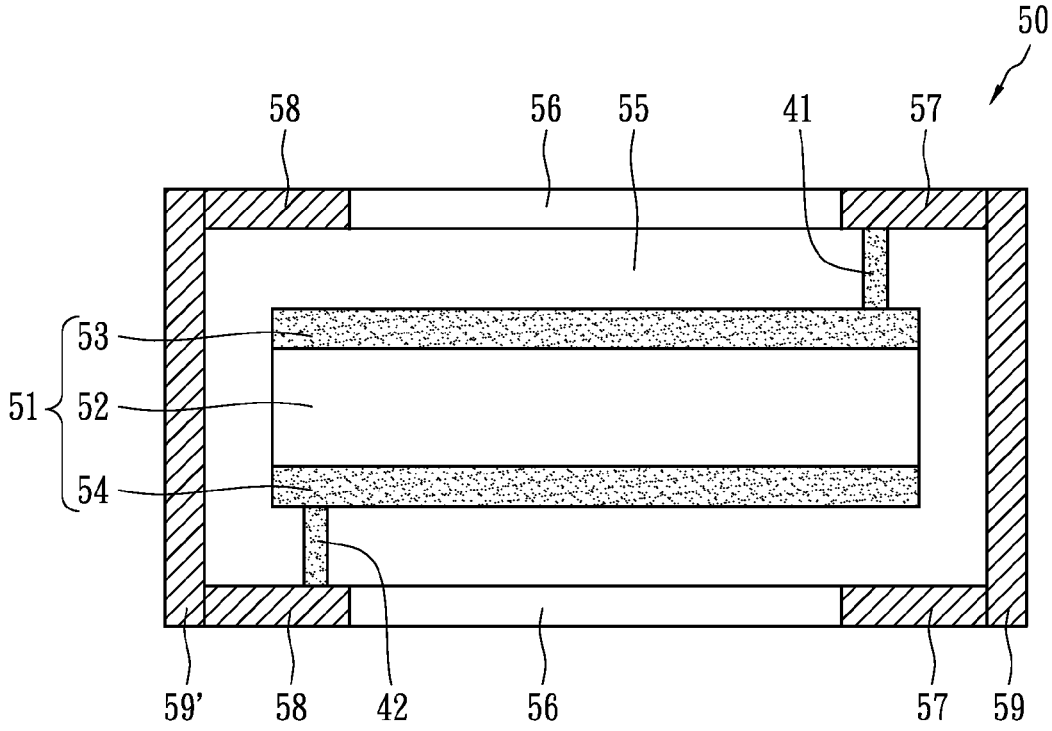
FIG. 5 shows a surface mountable thermistor in accordance with a fourth embodiment of the present application.

FIG. 5 shows a surface mountable thermistor 50 in accordance with a fourth embodiment of the present application. The thermistor 50 comprises a resistive device 51, a first electrode 57, a second electrode 58, a heat conductive dielectric layer 55, a first electrically conductive connecting member 59 and a second electrically conductive connecting member 59'. The resistive device 51 comprises a first electrically conductive member 53, a second electrically conductive member 54 and a polymeric material layer 52 laminated between the first electrically conductive member 53 and the second electrically conductive member 54. The heat conductive dielectric layer 55 encompasses the resistive device 51. The first electrically conductive connecting member 59 further comprises a conductive post 41 to electrically connect the first electrode 57 and the first electrically conductive member 53. Likewise, the second electrically conductive connecting member 59' further comprises a conductive post 42 to electrically connect the second electrode 58 and the second electrically conductive member 54.

Figure 6:
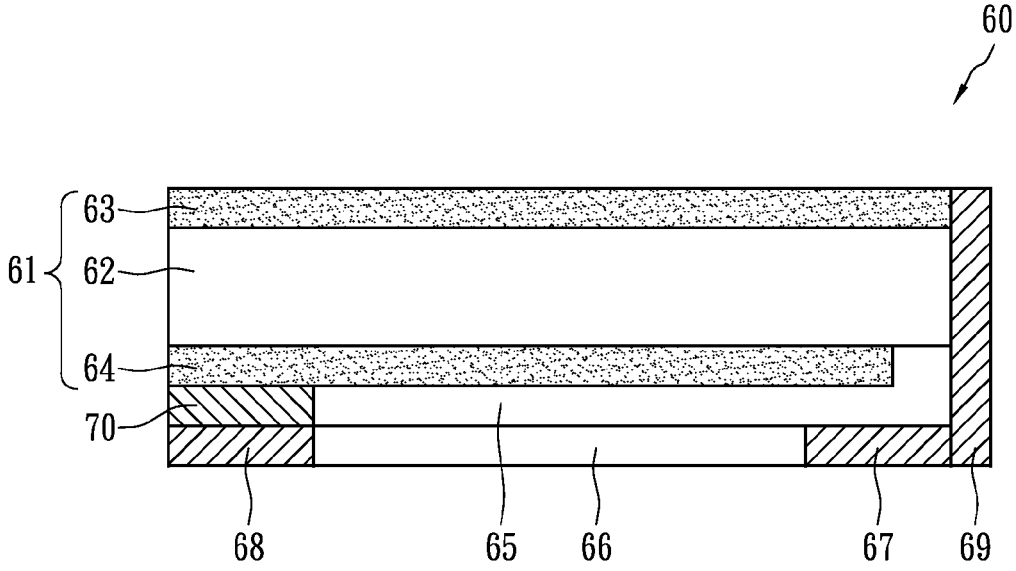
FIG. 6 shows a surface mountable thermistor in accordance with a fifth embodiment of the present application.

FIG. 6 shows a surface mountable thermistor 60 in accordance with a fifth embodiment of the present application. A resistive device 61 comprises a first electrically conductive member 63, a second electrically conductive member 64 and a polymeric material layer 62. The polymeric material layer 62 is laminated between the first electrically conductive member 63 and the second electrically conductive member 64, and exhibits PTC or NTC behavior. The polymeric material layer 62, the first and second electrically conductive members 63 and 64 commonly extend along a first direction to form a laminated structure. The first electrode 67 is electrically connected to the first electrically conductive member 63 through the first electrically conductive connecting member 69, whereas the second electrode 68 is electrically connected to the second electrically conductive member 64 through the second electrically conductive connecting member 70, and is insulated from the first electrode 67. A heat conductive dielectric layer 65 is disposed on a surface of the second electrically conductive member 64 and between the first electrode 67 and the second electrode 68, so as to insulate the first electrode 67 from the second electrode 68. Moreover, the first electrically conductive connecting member 69 extends along a second direction perpendicular to the first direction to electrically connect the first electrode 67 and the first electrically conductive member 63. The first electrically conductive connecting member 69 is insulated from the second electrically conductive member 64.

Compared to original SMD structure, the use of heat conductive dielectric layer can increase heat transfer efficiency. Therefore, the heat generated by the SMD in which current flows therethrough can be dissipated soon. Owing to the effective constraint to temperature rise, the hold current of the thermistor can be significantly increased. Accordingly, the SMD device of the present application can meet the demands of large current applications, and it may be associated with an adequate circuit design to enhance heat transfer efficiency and the sensitivity to ambient temperatures.

The above-described embodiments of the present invention are intended to be illustrative only. Numerous alternative embodiments may be devised by persons skilled in the art without departing from the scope of the following claims.

We claim:

1. A surface mountable thermistor, comprising:

a resistive device comprising a first electrically conductive member, a second electrically conductive member and a polymeric material layer, the polymeric material layer being laminated between the first electrically conductive member and the second electrically conductive member and exhibiting PTC or NTC behavior, wherein the polymeric material layer and the first electrically conductive member and the second electrically conductive member commonly extend along a first direction;

a first electrode electrically connected to the first electrically conductive member, the first electrode having heat conductivity at least 50 W/mK;

a second electrode electrically connected to the second electrically conductive member and being insulated from the first electrode, the second electrode having heat conductivity at least 50 W/mK; and at least one heat conductive dielectric layer comprising a polymeric insulation matrix and heat conductive filler, and being disposed between the first electrode and the second electrode, the heat conductive dielectric layer having heat conductivity between 1.2 W/mK and 13 W/mK.

2. The surface mountable thermistor of claim 1, further comprising:

a first electrically conductive connecting member extending along a second direction perpendicular to the first direction to electrically connect the first electrode and the first electrically conductive member, the first electrically conductive connecting member being insulated from the second electrically conductive member; and a second electrically conductive connecting member extending along the second direction to electrically connect the second electrode and the second electrically conductive member, and the second electrically conductive connecting member is insulated from the first electrically conductive member.

3. The surface mountable thermistor of claim 1, wherein the at least one heat conductive dielectric layer comprises a first heat conductive dielectric layer and a second heat conductive dielectric layer, the first heat conductive dielectric layer is disposed on the first electrically conductive member, and the second heat conductive dielectric layer is disposed on the second electrically conductive member.

4. The surface mountable thermistor of claim 3, wherein the first electrode comprises a pair of electrode foils disposed on the first heat conductive dielectric layer and the second heat conductive dielectric layer, and the second electrode comprises a pair of electrode foils disposed on the first heat conductive dielectric layer and the second heat conductive dielectric layer.

5. The surface mountable thermistor of claim 1, wherein the polymeric insulation matrix comprises interpenetrating network of thermosetting epoxy resin and thermoplastic, and the heat conductive filler comprises zirconium nitride, boron nitride, aluminum nitride, silicon nitride, aluminum oxide, magnesium oxide, zinc oxide, titanium dioxide or the mixture thereof.

6. The surface mountable thermistor of claim 1, wherein the polymeric insulation matrix comprises thermosetting epoxy resin with fiber dispersed therein, and the heat conductive filler comprises zirconium nitride, boron nitride, aluminum nitride, silicon nitride, aluminum oxide, magnesium oxide, zinc oxide, titanium dioxide or the mixture thereof.

7. The surface mountable thermistor of claim 1, wherein the first electrode or the second electrode is a foil comprising nickel, copper, aluminum, lead, tin, silver, gold, or the alloy thereof, a copper foil plated with nickel, a copper foil plated with tin or a stainless foil plated with nickel.

8. The surface mountable thermistor of claim 1, wherein at least one solder mask is formed between the first electrode and the second electrode for insulation.

9. The surface mountable thermistor of claim 1, wherein the heat conductive dielectric layer has heat conductivity between 2 W/mK and 12 W/mK.

* * * * *